United States Patent [19]

Volpert

[11] Patent Number: 4,838,551

[45] Date of Patent: Jun. 13, 1989

[54] CARD GAME PUZZLE PLAYING METHOD

[75] Inventor: Thomas R. Volpert, Chicago, Ill.

[73] Assignee: Mind Over Matter Games, Inc., Chicago, Ill.

[21] Appl. No.: 147,069

[22] Filed: Jan. 25, 1988

Related U.S. Application Data

[63] Continuation of Ser. No. 916,505, Oct. 8, 1986, abandoned.

[51] Int. Cl.[4] ..... A63F 9/10

[52] U.S. Cl. ..... 273/157 R; 273/273

[58] Field of Search ..... 273/157 R, 269, 271, 273/273

[56] References Cited

U.S. PATENT DOCUMENTS

| | | | |
|---|---|---|---|
| 171,507 | 12/1875 | Dennis, Jr. . | |
| 239,879 | 4/1881 | Stranders . | |
| 819,915 | 5/1906 | Nelson . | |
| 1,217,632 | 2/1917 | Pritchard | 273/157 R |
| 1,558,229 | 10/1925 | Bowman . | |
| 1,570,906 | 1/1926 | McCord | 273/157 UX |
| 1,617,772 | 2/1927 | Sergel et al. . | |
| 2,228,486 | 1/1941 | Reichert | 273/273 |
| 2,383,081 | 8/1945 | Ribbe | 273/157 R |
| 2,726,087 | 12/1955 | Dunham | 273/273 |
| 3,759,526 | 9/1973 | Estvan, Jr. | 273/157 R |
| 3,817,531 | 6/1974 | King et al. | 273/157 R X |
| 3,937,472 | 2/1976 | Rice | 273/157 R |
| 4,050,698 | 9/1977 | Brown | 273/157 R X |
| 4,345,762 | 8/1982 | Lebelson | 273/157 R |
| 4,586,714 | 5/1986 | Lenkoff et al. | 273/157 R |

FOREIGN PATENT DOCUMENTS

| | | | |
|---|---|---|---|
| 10653 | 11/1911 | United Kingdom | 273/157 R |
| 553798 | 6/1943 | United Kingdom | 273/157 R |

OTHER PUBLICATIONS

Cleo Learning Aids Catalog, p. 148.

*Primary Examiner*—Anton O. Oechsle

*Attorney, Agent, or Firm*—Wood, Dalton, Phillips, Mason & Rowe

[57] ABSTRACT

A card game puzzle including a supporting surface comprising a memory aid to be used at the option of a player. The supporting surface has a puzzle picture thereon and is adapted to support a plurality of cards. A plurality of cards are provided which are adapted to be arranged in rows and columns, and on the supporting surface at the option of the player, with each of the cards being rectangular in shape and having a first side with a different distinct segment of the puzzle picture thereon and a second side with identifying indicia such as the complete puzzle picture to be completed by arranging the cards in puzzle fashion thereon. The cards can be borderless and then properly arranged to complete the puzzle picture in uninterrupted fashion. In one embodiment, the card game puzzle includes a plurality of supporting surfaces and a plurality playing cards sets for multiple player card game utilization.

5 Claims, 2 Drawing Sheets

CARD GAME PUZZLE PLAYING METHOD

This application is a continuation of application Ser. No. 916,505, filed Oct. 8, 1986, abandoned.

FIELD OF THE INVENTION

This invention relates to cards, games and puzzles, and more specifically, to a puzzle which is completed by utilizing cards that are played by rules of a game.

BACKGROUND OF THE INVENTION

Over the years, puzzles have been played and enjoyed by millions. One of the chief enjoyments of puzzles is seeing a complete picture come to fruition by recognizing and correctly placing puzzle pieces that have only a small segment of the entire puzzle picture thereon. It is generally recognized, however, that one of the severe drawbacks to many puzzles is the inability of some, particularly young children, to correctly recognize the proper locations for the numerous puzzle pieces. One of the ways of attempting to overcome this drawback is to provide a puzzle with fewer puzzle pieces that are considerably larger in size. By so doing, the puzzle is easier to assemble, even for children of young age.

Nevertheless, when difficulty of the puzzle is reduced, the puzzle is able to hold the attention of a child for less time. After the puzzle has been measured, the child can usually repeat assembly of the puzzle very quickly and without much challenge, and the puzzle soon becomes discarded. Moreover, with simple puzzles, the parent is far less likely, due to the simple nature of the exercise, to engage in valuable playtime with the child.

Of course, it is also well recognized that young children find card games to be enjoyable. In fact, most children enjoy the mere act of playing with ordinary playing cards, quite apart from the many specialized card games specifically directed at young children. In this regard, specialized card games are usually conceived with the specific object of inviting parent participation.

Unfortunately, many specialized card games are sufficiently junevile to actually discourage parent participation. In other cases, primarily involving the use of skill rather than chance, the child can easily become discouraged or the parent must occasionally let the child win, due to the superior skills of the parent. In either case, frustration of both the parent and the child is the unfortunate result.

Generally speaking, many games have been proposed over the years. Such games have ranged the gambit from the most simple to extremely complex, but most games have had numerous and diverse small pieces that can be harmful to young children if improperly handled and can easily become lost or misplaced. Additionally, such games are usually discarded after a relatively short time.

Among the various attempts to provide puzzles, cards and games are those disclosed in U.S. Pat. Nos. 4,586,714; 4,050,698; 3,937,472; 3,759,526; 2,383,081; 1,617,772; 1,558,229; 1,217,632; 819,915; 239,879; and 171,507. Nevertheless, it has remained to provide a card game puzzle that successfully overcomes the above stated problems and completely accomplishes the stated objects by enhancing parent-child participation.

SUMMARY OF THE INVENTION

Accordingly, the present invention is directed to a method of playing a card game puzzle including the step of providing a supporting surface comprising a memory aid to be used at the option of a player. The supporting surface has a puzzle picture thereon. A plurality of cards are adapted to be arranged in rows and columns on the supporting surface with each of the cards being rectangular in shape and having a first side with a different distinct segment of the puzzle picture thereon and a second side with means thereon for identifying the puzzle picture to be completed by arranging the cards in puzzle fashion. The cards are adapted to be properly arranged to complete the puzzle picture. If the player so chooses, the cards can be placed on the supporting surface and arranged to complete the puzzle picture thereon.

In the exemplary embodiment, the cards are formed such that the different distinct segments of the puzzle picture are borderless. This facilitates completion of the puzzle picture in uninterrupted fashion, and it is also advantageous for the means for identifying the puzzle picture to be a complete puzzle picture on the second side of the cards which is illustrated in reduced fashion. Of course, this is particularly useful where a plurality of supporting surfaces and a plurallity of playing card sets are provided in each card game puzzle.

In the latter case, the supporting surfaces each have a different puzzle picture thereon. It will also be appreciated that the playing card sets are each adapted to be arranged in horizontal rows and vertical columns and on one of the supporting surfaces at the option of the players. In this manner, the level of difficulty of the card game puzzle can be controlled by selecting the number of playing card sets utilized.

Additionally, with a plurality of playing card sets, the cards of the playing card sets are shuffled and dealt. Specifically, the cards are dealt in substantially their entirety to all of the players so that each player has an equal number of cards with any of the cards remaining being placed in position with the first sides thereof facing upwardly, and then one of the players starts play by laying down one of the cards of one of the playing card sets and thereafter playing other of the cards of that same playing card set so long as the player can play cards that are vertically or horizontally adjacent to the one of the cards just played, after which another of the players plays one of the cards of that same playing card set and thereafter plays other of the cards thereof in like fashion. In this manner, the cards are played in turn by each of the players until the cards of that playing card set have all been played.

At this point, the player playing the last of the cards of that playing card set plays one of the cards of the remainder of the playing card sets and then plays other of the cards so long as the cards are vertically or horizontally adjacent the one of the cards jsut played, with play continuing among the players until one of the players is without cards which results in that player being declared the game winner.

As will be appreciated, the card game puzzle playing method has the attribute of cards, a game, and a puzzle. It is also sufficiently simple to be played by young children while sufficiently interesting to invite the participation of a parent or other adult. Moreover, if desired, the card game puzzle can be made sufficiently complex for exclusive adult participation.

Other objects, advantages and features of the present invention will become apparent from the following specification taken in conjunction with the accompanying drawing.

DETAILED DESCRIPTION OF THE PREFERRED EMBODIMENT

Figure 1:
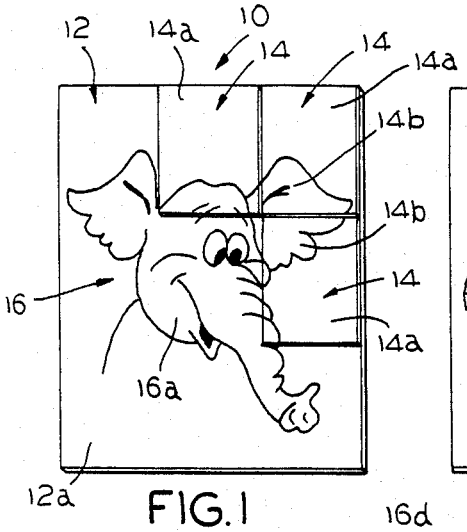
FIG. 1 is a top plan view of a supporting surface having a first puzzle picture with several cards arranged thereon.
Figure 2:
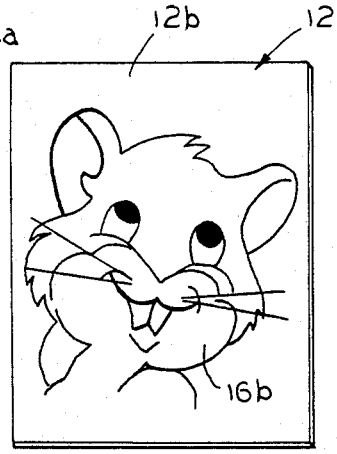
FIG. 2 is a top plan view of a supporting surface having a second puzzle picture without any cards arranged thereon.
Figure 3:
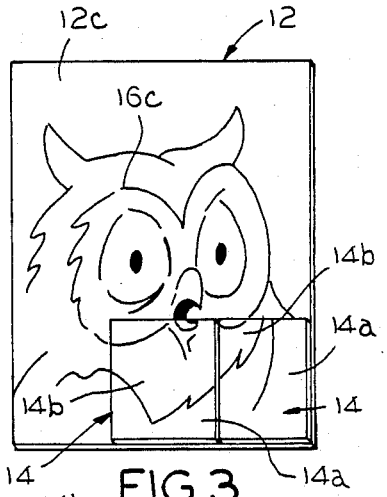
FIG. 3 is a top plan view of a supporting surface having a third puzzle picture with a pair of cards arranged thereon.
Figure 4:
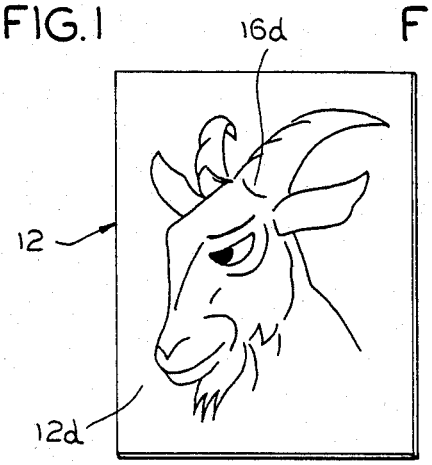
FIG. 4 is a top plan view of a supporting surface having a fourth puzzle picture without any cards arranged thereon.
Figure 5:
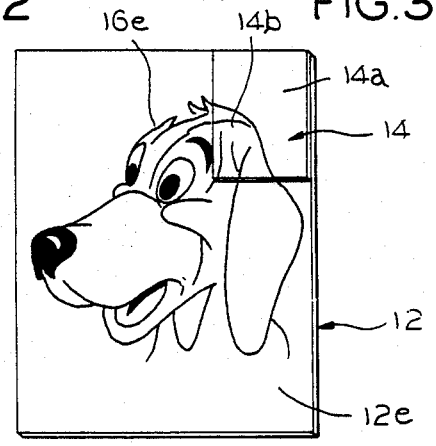
FIG. 5 is a top plan view of a supporting surface having a fifth puzzle picture with a single card arranged thereon.
Figure 1A:
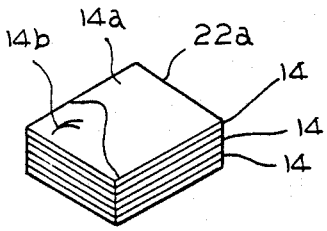
FIG. 1A is a perspective view of the remaining cards to complete the first puzzle picture of FIG. 1.
Figure 2A:
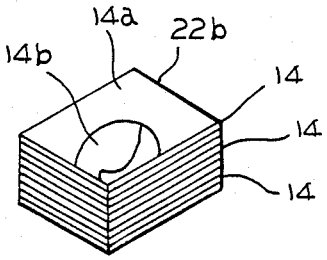
FIG. 2A is a perspective view of a stack of cards to form the second puzzle picture of FIG. 2.
Figure 3A:
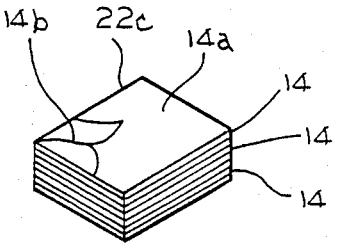
FIG. 3A is a perspective view of the remaining cards to complete the third puzzle picture of FIG. 3.
Figure 4A:
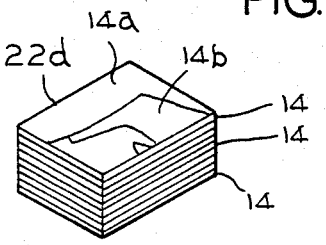
FIG. 4A is a perspective view of a stack of cards to form the fourth puzzle picture of FIG. 4.
Figure 5A:
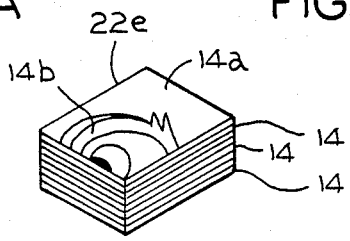
FIG. 5A is a perspective view of the remaining cards to complete the fifth puzzle picture of FIG. 5.

An exemplary embodiment of a card game puzzle in accordance with the invention is illustrated in FIGS. 1 and 1A. The card game puzzle 10 includes a supporting surface 12 for a plurality of cards 14. The supporting surface 12 has a puzzle picture 16 thereon and comprises a memory aid to be used at the option of a player. Additionally, the plurality of cards 14 are adapted to be arranged in rows 18 and columns 20 (see FIG. 6).

As shown in the drawings, the cards 14 are each preferably rectangular in shape. It will also be noted that each of the cards 14 has a first side **14*a* with a different distinct segment 14*b* of the puzzle picture 16 thereon and a second side 14*c* with means thereon for identifying the puzzle picture 16 to be completed by arranging the cards 14 in puzzle fashion (see FIG. 7). With this arrangement, the cards 14 are adapted to be properly arranged to complete the puzzle picture 16**.

Figure 6:
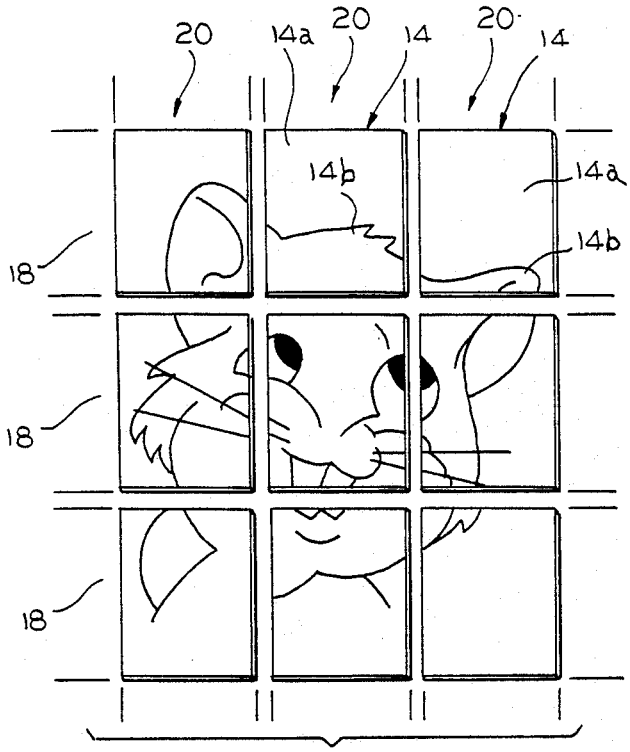
FIG. 6 is a top plan view of cards loosely arranged to illustrate the first sides thereof.

As shown in FIG. 6, the different distinct segments **14*b* of the puzzle picture 16 are borderless. Of course, as previously mentioned, the different distinct segments 14*b* are provided on the first side 14*a* of the cards 14. By utilizing no borders on the cards 14, the puzzle picture 16 can be completed in an uninterrupted fashion after properly arranging the cards 14**.

Figure 7:
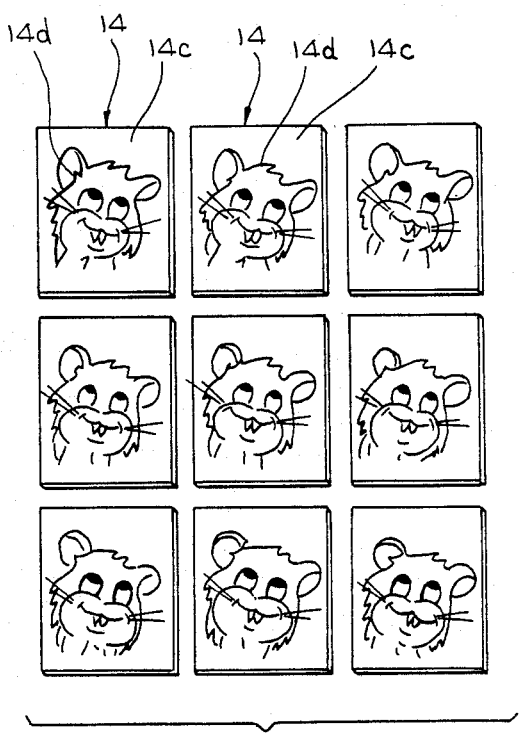
FIG. 7 is a top plan view of cards loosely arranged to illustrate the second sides thereof.

Referring specifically to FIG. 7, the means for identifying the puzzle picture 16 is a complete puzzle picture **14*d* on the second side of the cards. It is possible, however, to use other identifying indicia on the second side 14*c* of the cards 14 such as a descriptive word for the puzzle picture 16 or the like. However, in the illustrated embodiment, the mere fact that the cards 14 are much smaller than the puzzle picture 16 means that the puzzle picture 14d** is illustrated in reduced fashion.

As shown in FIG. 6, the rows 18 each include at least three of the cards 14 and the columns 20 also each include at least three of the cards 14. In practice, it is preferred for the rows 18 and the columns 20 to each include exactly three of the cards 14, although this can be expanded in order to enhance the difficulty of the card game puzzle 10. With this arrangement, the cards 14 are each adapted to be arranged in one of at least three rows 18 and each of the cards 14 is also adapted to be arranged in one of at least three columns 20.

Preferably, a plurality of supporting surfaces **12*a* through 12*e* (see, for instance, FIGS. 1–5) are provided for cards of a plurality of playing card sets 22*a* through 22*e* (see, for instance, FIGS. 1A–5A). Once again, the supporting surfaces 12*a* through 12e comprise memory aids adapted to be used at the option of the players and the supporting surfaces 12*a* through 12*e* each have a different puzzle picture 16*a* through 16*e*** thereon.

As mentioned, and referring to FIGS. 1A–5A, a plurality of playing card sets **22*a* through 22*e* are provided. The playing card sets 22*a* through 22*e* are each adapted to be arranged in the horizontal rows 18 and the vertical columns 20 and on one of the supporting surfaces 12*a* through 12*e* having the puzzle pictures 16*a* through 16*e* thereon, respectively, at the option of the players. As shown, the playing card sets 22*a* through 22*e* each include a plurality of rectangular cards 14**.

As before, the rectangular cards 14 have first sides **14*a* with different distinct segments 14*b* of one of the different puzzle pictures 16*a* through 16*e* thereon. The second sides 14*c* are also again provided with means thereon such as a complete puzzle picture 14*d* of reduced size and identical to means on the remainder of the cards 14 of the corresponding one of the playing card sets 22*a* through 22*e* for identifying the one of the different puzzle pictures 16*a* through 16*e* to be completed by arranging the cards of the playing card sets 22*a* through 22*e* in puzzle fashion. With this arrangement, the playing card sets 22*a* through 22*e* are such that the cards 14 are adapted to be properly arranged in the hands of the players to facilitate completion of the different puzzle pictures 16*a* through 16*e***.

With a plurality of supporting surfaces **12*a* through 12*e* and playing card surfaces 22*a* through 22*e*, the cards 14 of the playing card sets 22*a* through 22*e* are shuffled and dealt in substantially their entirety to all of the players in equal members. Any of the cards 14 of any of the playing card sets 22*a* through 22*e* remaining after the cards have been dealt are placed in position on the corresponding one(s) of the supporting surfaces 12*a* through 12*e* with the first sides 14*a*** thereof facing upwardly after which the players are ready to begin play.

In particular, one of the players thereafter lays down one of the cards 14 of one of the playing card sets **22*a* through 22*e* and thereafter plays other of that same playing card set so long as the cards are vertically or horizontally adjacent to the one of the cards 14 just played. When that player can play no further cards horizontally or vertically of a card just played, or elects not to play further cards after playing the required minimum of at least one playable card in his or her hand, another of the players plays one of the cards 14 of that same playing card set and thereafter plays other of the cards 14 of the playing card set, all in like fashion, and the cards 14 are played in turn by each of the players until the cards 14 of that playing card set have all been played. When this occurs, the player playing the last of the cards 14 of that playing card set thereafter plays one of the cards of another of the playing card sets 22***a* through 22*e* and thereafter plays other of the cards 14 so long as the cards are vertically or horizontally adjacent the one of the cards 14 just played.

In playing the game, it will be appreciated that it is never permissible for a player to lay down a card diagonally of a card just played. Also, in playing the game, it will be appreciated that it is permissible as a matter of strategy for a player to play less than all of the playable cards in any one turn so long as at least one playable card is played.

By following the rules as stated, play continues among the players until one of the players is without cards. In this manner, the first player to be without cards can be considered to be the winner of the game.

As before, the different distinct segments 14*b* of the different puzzle pictures 16*a* through 16*e* are borderless on the first sides 14*a* of the cards 14 of the playing card sets 22*a* through 22*e*. This accommodates completion of the different puzzle pictures 16*a* through 16*e* in an uninterrupted fashion whereby the completed puzzle pictures appear exactly as the puzzle pictures appearing on the supporting surfaces 12*a* through 12*e*. Also, as before, complete puzzle pictures 14*d* are provided on the second sides 14*c* of the cards 14 of the playing card sets 22*a* through 22*e* to serve as identifying means to aid the players.

Figure 8:
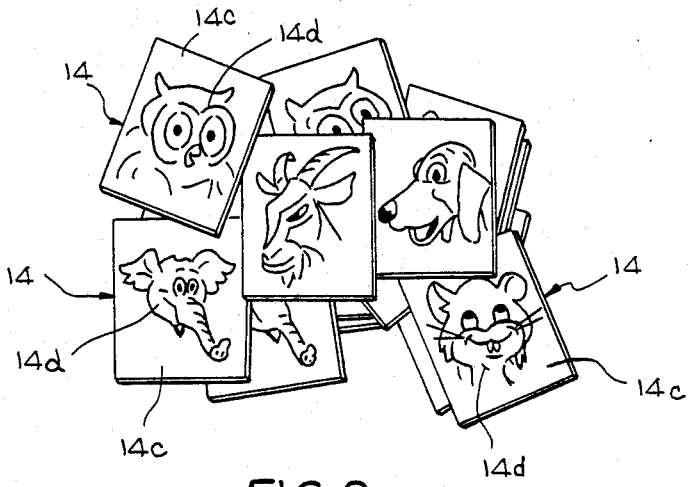
FIG. 8 is a top plan view of the second sides of various ones of the cards from FIGS. 1A through 5A.

As will be appreciated by referring to FIG. 8, this facilitates grouping the cards 14 after they have been shuffled and dealt. It is simply a matter of grouping the cards according to the complete picture illustrated in reduced form on the second sides 14*c* of the cards 14 so as to facilitate playing the cards 14 depending upon the one of the playing card sets 22*a* through 22*e* being played at any one time. When shifting to another of the playing card sets 22*a* through 22*e*, it is a simple matter once again for the cards 14 being held by each of the players to be considered for play by the player.

Preferably, the card game puzzle 10 contains five supporting surfaces 12*a* through 12*e*. It is also preferred for there to be nine playing cards 14 for each of the playing card sets 22*a* through 22*e* corresponding to the puzzle pictures 16*a* through 16*e* on the five supporting surfaces 12*a* through 12*e*. As will be appreciated, the supporting surfaces 12*a* through 12*e* are utilized as memory aids for players to learn the makeup of the puzzles.

If it is desired to play a version of solitaire, the player simply picks the playing card set 22*a* through 22*e* it is desired to use at any given time. If the corresponding supporting surface is to be used as a memory aid, it is placed on a table or other surface in front of the player and the corresponding nine cards 14 are shuffled with the reduced complete puzzle picture sides facing up and the cards 14 in a pile after shuffling. With this done, the player takes the top card and places it in the correct position of the supporting surface.

Thereafter, the player picks the next card 14 and determines whether it is vertically or horizontally adjacent the one of the cards 14 just played. If not, it is placed on the bottom of the pile, and the player draws the next card and makes the same determination which continues until the entire puzzle is finished.

For two players, the dealer shuffles the nine cards and deals four cards to each player with the reduced complete puzzle picture sides facing upwardly. The remaining card starts the puzzle and, as a result, it is turned up and placed on a table or other supporting surface, or on the supporting surface forming the memory aid in the correct position. When this has been done, the dealer is the first to play any card that can be placed vertically or horizontally adjacent the one of the cards turned up after dealing.

In this manner, the dealer can play until there are no further cards that can be placed vertically or horizontally adjacent the one of the cards just played. Then, unless the dealer has played all of the cards in the dealer's hand, the other player proceeds in like fashion. Until a player wins by being the first to be without cards, play continues to alternate between the two players following the same procedure.

Similarly, additional players can play the card game puzzle by utilizing more of the playing card sets 22*a* through 22*e*. In fact, with one, two, or even ten players, the number of the playing card sets utilized at any one time can be varied based upon the number of players and/or the complexity and length of time of the game which is wished to be played. Similarly, the complexity can be varied by adding to the number of cards in each of the playing card sets 22*a* through 22*e*.

As will be appreciated, the card game puzzle 10 has sufficient flexibility to overcome the problems as aforesaid. It also accomplishes the objective of providing the attributes of cards, games and puzzles in a manner which can nbe enjoyed by parents and children in a mutually satisfactory fashion thereby encouraging interaction between parents and children. Moreover, the card game puzzle 10 has attributes that make it possible for advanced versions to be realistically provided for adults-only play.

While in the foregoing there has been set forth a preferred embodiment of the invention, it is to be understood that the invention is only to be limited by the spirit and scope of the appended claims.

I claim:

1. A method of playing a card game puzzle for one or more players, comprising the steps of:

providing a plurality of supporting surfaces for cards of a plurality of playing card sets, said supporting surfaces comprising memory aids adapted to be used at the option of said players, each of said supporting surfaces having a different puzzle picture thereon; and providing a plurality of playing cards sets each adapted to be arranged in horizontal rows and vertical columns and on one of said supporting surfaces at the option of said players, each of said playing card sets including a plurality of rectangular cards having first sides with different distinct segments of one of said different puzzle pictures thereon and second sides with means thereon identical to means on the remainder of said cards of the corresponding one of said playing card sets for identifying the one of said different puzzle pictures to be completed by arranging said cards of said playing card set in puzzle fashion, said playing card sets being such that said cards are adapted to be properly arranged to complete said different puzzle pictures and on one of said supporting surfaces at the option of said players;

shuffling and dealing said cards of said playing card sets in equal numbers and in substantially their entirety to all of said players with any of said cards of any of said playing card sets remaining after said cards have been dealt being placed in position with said first sides thereof facing upwardly, one of said players thereafter laying down one of said cards of one said playing card sets and thereafter playing other of said cards of the one of said playing card sets so long as said cards are vertically or horizontally adjacent the one of said cards just played after which another of said players plays one of said cards of the one of said playing card sets and thereafter plays other of said cards of the one of said playing card sets in like fashion, said cards being played in turn by each of said players until said cards of the one of said playing card sets have all been played;

said player playing the last of said cards of the one of said playing card sets thereafter playing one of said cards of another of said playing card sets and thereafter playing other of said cards so long as the cards are vertically or horizontally adjacent the one of said cards just played with play continuing among said players until one of said players is without cards;

whereby the first player to be without cards is the game winner.

2. The method of playing a card game puzzle as defined by claim 1 wherein said different distinct segments of said different puzzle pictures of said playing card sets are borderless on said first sides of said cards for completion of said different puzzle pictures in uninterrupted fashion.

3. The method of playing a card game puzzle as defined by claim 1 wherein said means for identifying the corresponding one of said different puzzle pictures of said playing card sets are complete puzzle pictures on said second sides of said cards illustrated in reduced fashion.

4. The method of playing a card game puzzle as defined by claim 1 wherein said horizontal rows of each of said playing card sets include at least three of said cards thereof and said vertical columns of each of said playing card sets include at least three of said cards thereof.

5. The method of playing a card game puzzle as defined by claim 1 wherein said cards of each of said playing card sets are adapted to be arranged in one of three of said horizontal rows and in one of three of said vertical columns on the corresponding one of said supporting surfaces.

* * * * *